US006361233B1

(12) United States Patent
Yamanaka et al.

(10) Patent No.: US 6,361,233 B1
(45) Date of Patent: Mar. 26, 2002

(54) ROD-SHAPED CONTENT DRAW-OUT CONTAINER

(75) Inventors: Yasuhiro Yamanaka, Higashiosaka; Toshiki Kurumada, Nabari; Koji Miyagawa, Higashiosaka; Kenji Fukunaga, Kawachinagano, all of (JP)

(73) Assignee: M•F•V Co., Ltd., Osaka-fu (JP)

( * ) Notice: Subject to any disclaimer, the term of this patent is extended or adjusted under 35 U.S.C. 154(b) by 0 days.

(21) Appl. No.: 09/381,133

(22) PCT Filed: Mar. 17, 1997

(86) PCT No.: PCT/JP97/00843

§ 371 Date: Sep. 16, 1999

§ 102(e) Date: Sep. 16, 1999

(87) PCT Pub. No.: WO98/41122

PCT Pub. Date: Sep. 24, 1998

(51) Int. Cl.[7] ..... A45D 40/04
(52) U.S. Cl. ..... 401/68; 401/69; 401/74
(58) Field of Search ..... 401/68, 69, 74, 401/75, 80, 84

(56) References Cited

U.S. PATENT DOCUMENTS

| | | | | | |
|---|---|---|---|---|---|
| 2,546,195 A | * | 3/1951 | Mellette | ..... | 401/69 |
| 5,653,338 A | * | 8/1997 | Tani | ..... | 401/69 |

FOREIGN PATENT DOCUMENTS

| | | | | | |
|---|---|---|---|---|---|
| JP | 611089 | | 1/1986 | | |
| JP | 418497 | | 4/1992 | | |
| JP | 59415 | | 2/1993 | | |
| JP | 8352 | | 1/1996 | | |
| JP | 84891 | | 2/1996 | | |
| WO | 92/09220 | * | 6/1992 | ..... | 401/68 |

* cited by examiner

*Primary Examiner*—Charles R. Eloshway
(74) *Attorney, Agent, or Firm*—Rothwell, Figg, Ernst & Manbeck

(57) ABSTRACT

A rod-shaped content draw-out container includes a draw-out mechanism of a multi-stage joint structure including a shell cylinder, a relay cylinder provided inside a rotation operating cylinder rotatably coupled to a rear end of the shell cylinder. The relay cylinder is inhibited from rotating relative to the rotation operating cylinder but is allowed to advance and retreat axially. A push-out rod member is screwed to the relay cylinder by reversely threaded screws and is inhibited from rotating relative to the shell cylinder but allowed to advance and retreat axially. To prevent the rotation operating cylinder from improvidently rotating and to allow a user to easily recognize limits of operation, first stoppers formed on the relay cylinder and the push-out rod member engage each other at a positional change from a position just before the draw-in end to the draw-in end. Second stoppers formed on the shell cylinder and the relay cylinder engage each other at a positional change from a position just before the draw-out end to the draw-out end.

4 Claims, 14 Drawing Sheets

ROD-SHAPED CONTENT DRAW-OUT CONTAINER

TECHNICAL FIELD

The present invention relates to draw-out containers capable of drawing out rod-shaped contents such as rouge, lip cream or paste and, more particularly, to a draw-out container in which a content draw-out mechanism is formed into a multi-stage joint structure.

BACKGROUND ART

Conventionally, a draw-out container in which a rod-shaped content draw-out mechanism is formed into a multi-stage joint structure is described in, for example, Japanese Utility Model Publication 61-1089. This container, as shown in FIG. 1, which is a half sectional view of a drawn-in state, and FIG. 2, which is a half sectional view of a drawn-out state, comprises a shell cylinder 1, a cap 2 removably fitted to a fore end of the shell cylinder (FIG. 2 shows a state in which the cap has been removed), a rotation operating cylinder 3 rotatably coupled to a rear end of the shell cylinder 1, a relay cylinder 4 which is screwed to a rear-end inner circumferential surface of the shell cylinder 1 and which is inhibited from rotating relative to the rotation operating cylinder 3 but allowed to advance and retreat in the axial direction, and a push-out rod member 5 which is screwed in the counter-threaded direction to an inner circumferential surface of the relay cylinder 4 and which is inhibited from rotating relative to the shell cylinder 1 but allowed to advance and retreat in the axial direction, where a receiver 5*a* of a fore end of the push-out rod member 5 is holding a rear end of a rod-shaped content 6.

In this constitution, when the rotation operating cylinder 3 is rotated in a draw-out direction at any position other than a draw-out end (the state of FIG. 2 in which the rod-shaped content 6 has been drawn out to the most), the relay cylinder 4 is advanced relative to the rotation operating cylinder 3, while the push-out rod member 5 is advanced relative to the relay cylinder 4, by which the rod-shaped content 6 is drawn out. Also, when the rotation operating cylinder 3 is rotated in the reverse direction at any position other than a draw-in end (the state of FIG. 1 in which the rod-shaped content 6 has been drawn in to the most), the rod-shaped content 6 is drawn in by reversely directed movement of the relay cylinder 4 and the push-out rod member 5.

In this container, the relay cylinder 4 and the push-out rod member 5 are provided to serve as screws, and a rotational motion of the rotation operating cylinder 3 is transformed into a straight advancement motion of the rod-shaped content 6 by using the screws. Therefore, there has been a possibility that the content may move improvidently if the screws are loosened due to vibrations during transport or carriage. Besides, because of indefinite limits of rotational operation, there has been a further possibility that the screws may be damaged by excessively rotating the rotation operating cylinder 3 during the operation.

Therefore, a technical issue to be solved by the present invention is to provide a rod-shaped content draw-out container having a draw-out mechanism of a multi-stage joint structure in which the screws are inhibited from improvidently rotating, and in which a user is enabled to easily recognize the limits of operation.

DISCLOSURE OF THE INVENTION

According to the present invention, there is provided a rod-shaped content draw-out container comprising: a shell cylinder having a screwer in an inner circumferential surface of a rear end; a rotation operating cylinder rotatably coupled to the rear end of the shell cylinder; a relay cylinder which has an outside screw to be screwed to the screwer of the shell cylinder and which is inhibited from rotating relative to the rotation operating cylinder but allowed to advance and retreat axially, and further which has a screwer formed in an inner circumferential surface; a push-out rod member which has an outside screw to be screwed to the screwer of the relay cylinder and which is inhibited from rotating relative to the shell cylinder but allowed to advance and retreat axially, and further which has, at its fore end portion, a receiver for holding a rear end of a rod-shaped content, wherein the outside screw of the relay cylinder and the outside screw of the push-out rod member are threaded reverse to each other. In order to solve the aforementioned technical issue, the rod-shaped content draw-out container is characterized by having the following constitution:

That is, a pair of first stoppers to be engaged each other at a draw-in end are formed in the inner circumferential surface of the relay cylinder and an outer circumferential surface of the push-out rod member, the first stoppers comprising one protrusion and another protrusion which go axially beyond each other at a positional change from a position just before the draw-in end to the draw-in end, or a protrusion and a recessed portion which are fitted to each other at the positional change. Also, a pair of second stoppers to be engaged at a draw-out end are formed in the inner circumferential surface of the shell cylinder and an outer circumferential surface of the relay cylinder, the second stoppers comprising one protrusion and another protrusion which go axially beyond each other at a positional change from a position just before the draw-out end to the draw-out end, or a protrusion and a recessed portion which are fitted to each other at the positional change. The screwers may be formed as inside screws along the screwing direction of the outside screws, or as mere protrusions, respectively.

With this constitution, at the draw-in end and the draw-out end, loosening of the screws can be prevented by the first stoppers and the second stoppers, respectively. Therefore, the content can be prevented from improvidently moving within the container due to vibrations during transport or carriage. Also, in a change from the position just before the draw-out end to the draw-out end, as well as in a change from the position just before the draw-in end to the draw-in end, a clicking feeling is obtained by one protrusion and another protrusion, or a protrusion and a recessed portion, formed as the two stopper means, thus allowing the user to easily recognize the limits of operation. As a result, damage of the screws due to excessive rotation of the rotation operating cylinder 13 during the operation can be prevented.

Further, it is also possible that the relay cylinder has a fore end face to be opposed to a lower face of the receiver at a draw-in end position, and a flange to be opposed to a lower face of the shell cylinder at a draw-out position, where a pair of first stoppers may be formed in the fore end face of the relay cylinder and the lower face of the receiver of the push-out rod member as one protrusion and another protrusion which go beyond each other in a rotational direction at a positional change from a position just before the draw-in end to the draw-in end, or as a protrusion and a recessed portion which are fitted to each other at the positional change, and where a pair of second stopper may be formed in the lower face of the shell cylinder and an upper face of the flange of the relay cylinder, as one protrusion and another protrusion which go beyond each other in the rotational direction at a positional change from a position just before the draw-out end to the draw-out end, or as a protrusion and a recessed portion which are fitted to each other at the positional change.

Furthermore, the pair of first stoppers and the pair of second stoppers may be formed as a combination of one protrusion and another protrusion, or a protrusion and a recessed portion, which are fitted to each other by a positional change in the axial direction, and one protrusion and another protrusion, or a protrusion and a recessed portion, which are fitted to each other by a positional change in the rotational direction. More specifically, the first stoppers may comprise one protrusion and another protrusion, or a protrusion and a recessed portion, which are fitted to each other by a positional change in the axial direction, while the second stopper may comprise one protrusion and another protrusion, or a protrusion and a recessed portion, which are fitted to each other by a positional change in the rotational direction and, conversely, the first stoppers may comprise one protrusion and another protrusion, or a protrusion and a recessed portion, which are fitted to each other by a positional change in the rotational direction, while the second stoppers may comprise one protrusion and another protrusion, or a protrusion and a recessed portion, which are fitted to each other by a positional change in the axial direction.

With any one of these constitutions, since the screws do not loosen at the draw-in end and the draw-out end, the content can be prevented from improvidently moving due to vibrations during transport or carriage. Also, since the user can easily recognize the limits of operation, damage of the screws due to excessive rotation of the rotation operating cylinder can be prevented.

BEST MODE FOR CARRYING OUT THE INVENTION

Figure 1:
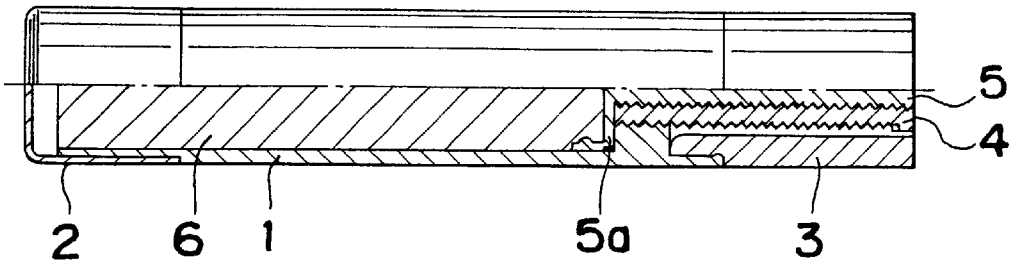
Fig. 1 (PRIOR ART)
FIG. 1 is a half sectional view of a rod-shaped content draw-out container according to the prior art in a drawn-in state.
Figure 2:
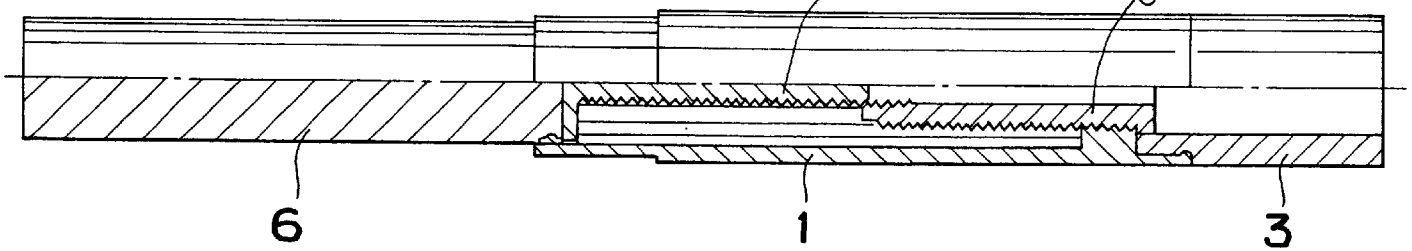
Fig. 2 (PRIOR ART)
FIG. 2 is a half sectional view of the rod-shaped content draw-out container of FIG. 1 in a drawn-out state.
Figure 3:
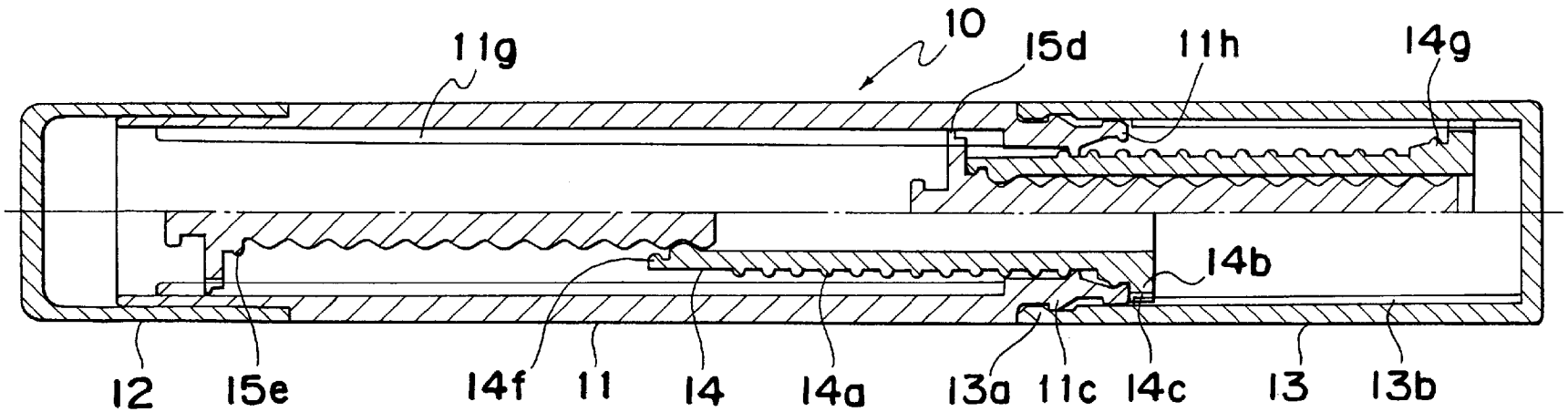
FIG. 3 is a sectional view showing a first embodiment of a rod-shaped content draw-out container according to the present invention, the upper half showing a drawn-in state and the lower half showing a drawn-out state.
Figure 4:
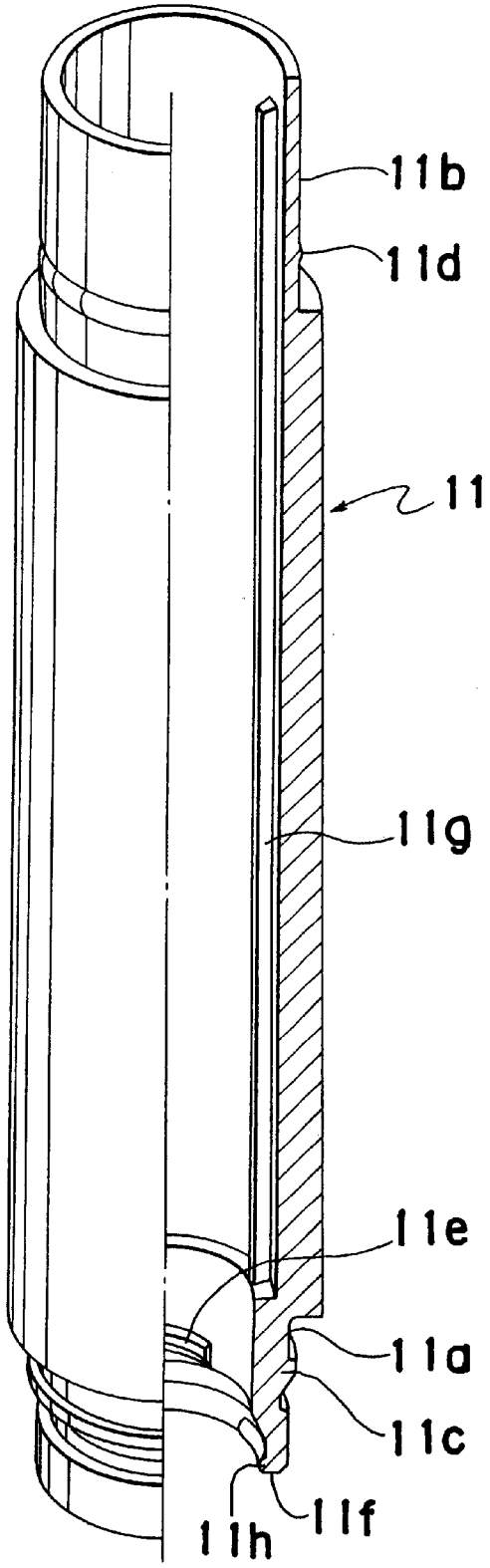
FIG. 4 is a partial sectional perspective view showing the shell cylinder of the container of FIG. 3.
Figure 5:
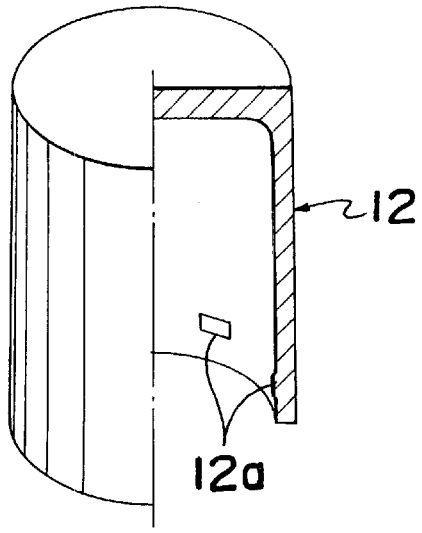
FIG. 5 is a partial sectional perspective view showing the cap of the container of FIG. 3.
Figure 6:
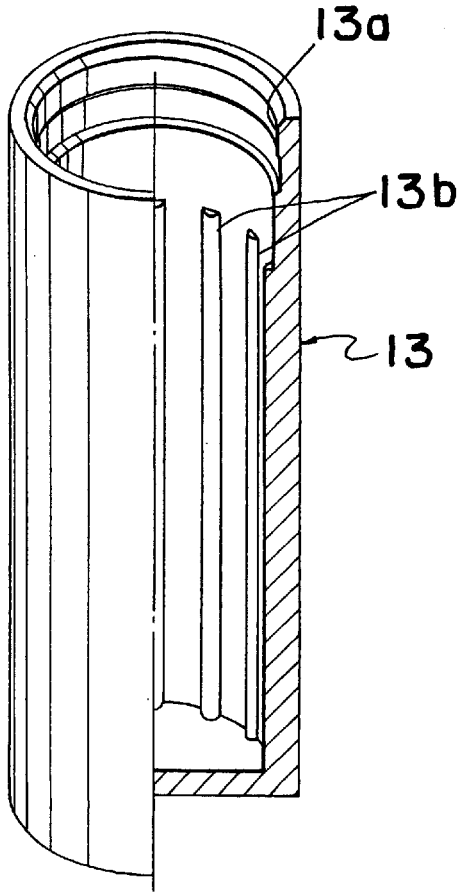
FIG. 6 is a partial sectional perspective view showing the rotation operating cylinder of the container of FIG. 3.
Figure 7:
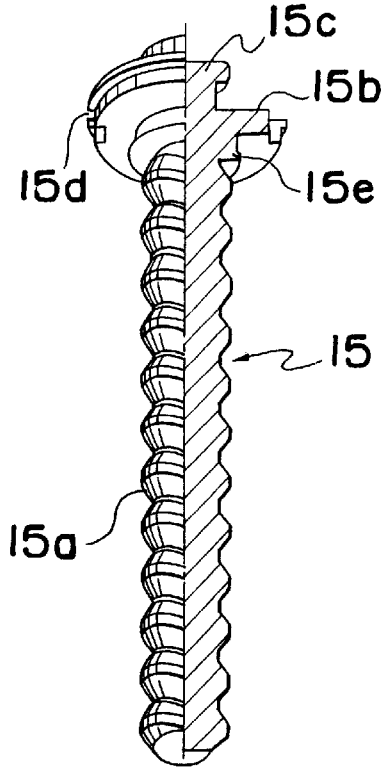
FIG. 7 is a partial sectional perspective view showing the push-out rod member of the container of FIG. 3.
Figure 8:
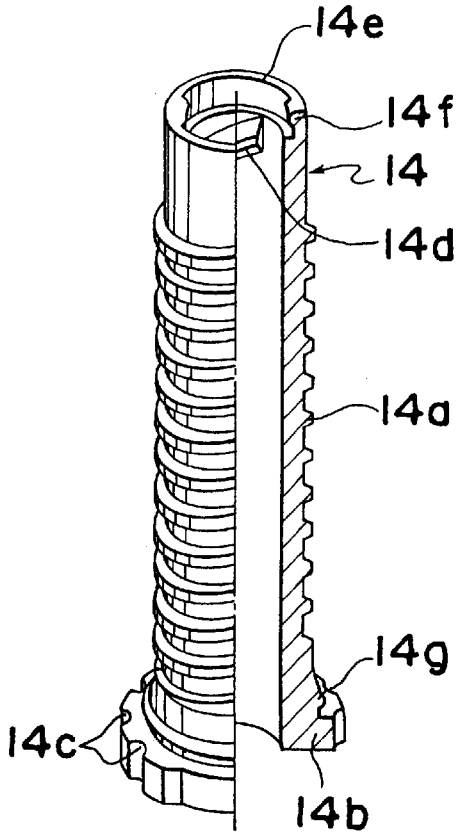
FIG. 8 is a partial sectional perspective view showing the relay cylinder of the container of FIG. 3.

A first embodiment of the rod-shaped content draw-out container according to the present invention is described in detail below with reference to FIGS. 3 through 9.

Throughout the drawings, the whole container is designated by reference numeral 10, in which 11 denotes a shell cylinder, 12 denotes a cap, 13 denotes a rotation operating cylinder, 14 denotes a relay cylinder and 15 denotes a push-out rod member. In addition, whereas rouge, lip cream, paste or the like is contained in this container as a rod-shaped content, the rod-shaped content is omitted in the drawings for convenience' sake.

The shell cylinder 11 has step portions 11*a,* 11*b* formed in outer circumferential surfaces of a rear end portion and a fore end portion, respectively. A circumferentially continuing ring-shaped claw 11*c* is formed in the outer circumferential surface of the step portion 11*a* on the rear end side of the shell cylinder 11, and a claw 13*a* to be engaged with this claw 11*c* of the shell cylinder 11 is formed in the inner circumferential surface of a fore end portion of the rotation operating cylinder 13. Like this, by engagement of these claws 11*c,* 13*a* of both members 11, 13 with each other, the rotation operating cylinder 13 is enabled to rotate relative to the shell cylinder 11. Also, a ring-shaped protrusion lid with a small extent of protrusion is formed in the outer circumferential surface of the step portion 11*b* on the fore end side of the shell cylinder 11, while a small protrusion 12*a* to be engaged with this protrusion lid is formed in the inner circumferential surface of the cap 12. By virtue of small extents of protrusion of the two protrusions 11*d,* 12*a* as well as a small engaging force between the shell cylinder 11 and the cap 12, the cap 12 can be easily fitted to and removed from the shell cylinder 11.

The relay cylinder 14 has two lines of outside screws 14*a* on its outer circumferential surface, and has at a rear end portion a flange 14*b* extending radially outwardly. In the flange 14*b,* guide grooves 14*c* extending axially of the relay cylinder 14 are formed at several points of the outer circumferential surface, and linear protrusions 13*b* to be engaged with these guide grooves 14*c* are formed circumferentially at equal intervals (30°) in the inner surface of the rotation operating cylinder 13. The guide grooves 14*c* of the relay cylinder 14 are formed so as to be grouped into threes at 30° intervals, so that the relay cylinder 14 can be fitted in any directions in steps of 30° relative to the rotation operating cylinder 13.

At the rear end portion of the inner circumferential surface of the shell cylinder 11, a screwer 11*e* to be screwed with the outside screws 14*a* of the relay cylinder 14 is formed. Because the rotation operating cylinder 13 is rotatable relative to the shell cylinder 11 and the relay cylinder 14 is axially slidable relative to the rotation operating cylinder 13 as described above, the relay cylinder 14, with the rotation operating cylinder 13 rotated, is advanced and retreated between two positions above and below a center line in FIG. 3. The upper side of the center line shows the draw-in end position (i.e., the position in which the relay cylinder 14 and the push-out rod member 15 are completely withdrawn into the shell cylinder 11), and the lower side shows the draw-out end position (i.e., the position in which the relay cylinder 14 and the push-out rod member 15 are fully extended with respect to the shell cylinder 11). In addition, as a stopper at the draw-out end position, the flange 14*b* formed at the rear end portion of the relay cylinder 14 contacts a lower face 11*f* of the shell cylinder 11 (FIG. 4) in this example. Otherwise, the stopper at the draw-out end may also be implemented in other forms.

The push-out rod member has two lines of outside screws 15*a* which are reversely threaded and doubled in lead with respect to the outside screws 14*a* of the relay cylinder 14, and a screwer 14*d* to be screwed with these outside screws 15*a* are formed at a fore end portion of the inner circumferential surface of the relay cylinder 14. A receiver 15*b* projecting in a flange shape is formed at a fore end portion (upper end portion in the figure) of the screw shaft, and a holder 15*c* for holding the rod-shaped content is formed in the upper face of the receiver 15*b*. In addition, as a stopper at the draw-in position, the lower face of the receiver 15*b* contacts a fore end face 14*e* of the relay cylinder 14 in this example. Otherwise, the lower end of the relay cylinder 14, for example, may contact the bottom face of the rotation operating cylinder 13.

Axially extending guide members 11*g* are formed at opposite two places in the inner circumferential surface of the shell cylinder 11, and guide grooves 15d to be engaged with these guide members 11*g* are formed in the outer circumferential surface of the receiver 15*b* of the push-out rod member 15. By the function of the guide members 11*g* and the guide grooves 15*d*, the push-out rod member 15 is made not rotatable relative to the shell cylinder 11 but slidable axially. Also, as described above, the outside screws 15*a* of the push-out rod member 15 are reversely threaded and larger (about double) in lead as compared with the outside screws 14*a* of the relay cylinder 14. Therefore, when the rotation operating cylinder 13 is rotated, the direction of relative rotation of the push-out rod member 15 to the relay cylinder 14 and the direction of relative rotation of the relay cylinder 14 to the shell cylinder 11 are opposite to each other, so that the push-out rod member 15 moves to about double the movement of the relay cylinder 14 in the same direction along the axis, thus being advanced and retreated between the draw-out position shown below the center line and the draw-in position shown above the center line in FIG. 3.

Meanwhile, at a fore end of the inner circumferential surface of the relay cylinder 14, two protrusions 14*f* protruding radially inwardly are formed opposite to each other, and an annular protrusion 15*e* to be engaged with the protrusions 14*f* of the inner circumferential surface of the relay cylinder 14 is formed at a position slightly away from the receiver 15*b* in a base end portion of the outer circumferential surface of the screw shaft of the push-out rod member 15. The two protrusions 14*f*, 15*e*, at a positional change from a position just before the draw-in end to the draw-in end, go axially beyond each other so as to be engaged with each other, thus constituting a first stopper means. In addition, the protrusions 14*f* may also be provided one or three or more in number, or formed into a circumferentially continuing annular protrusion, and the protrusion 15*e*, if to be engaged with the protrusions 14*f* at the draw-in end, may also be provided separate away circumferentially.

Also, at the rear end of the inner circumferential surface of the shell cylinder 11, two protrusions 11*h* protruding radially inwardly are formed opposite to each other, and an annular protrusion 14*g* to be engaged with the protrusions 11*h* of the inner circumferential surface of the shell cylinder 11 is formed at a position slightly away from the flange 14*b* in a base end portion of the outer circumferential surface of the relay cylinder 14. The two protrusions 11*h*, 14*g*, at a positional change from a position just before the draw-out end to the draw-out end, go axially beyond each other so as to be engaged with each other, thus constituting a second stopper means. In addition, the protrusions 11*h* may also be provided one or three or more in number, or formed into a circumferentially continuing annular protrusion, and the protrusion 14*g*, if to be engaged with the protrusions 11*h* at the draw-out end, may also be provided separate away circumferentially.

Figure 9:
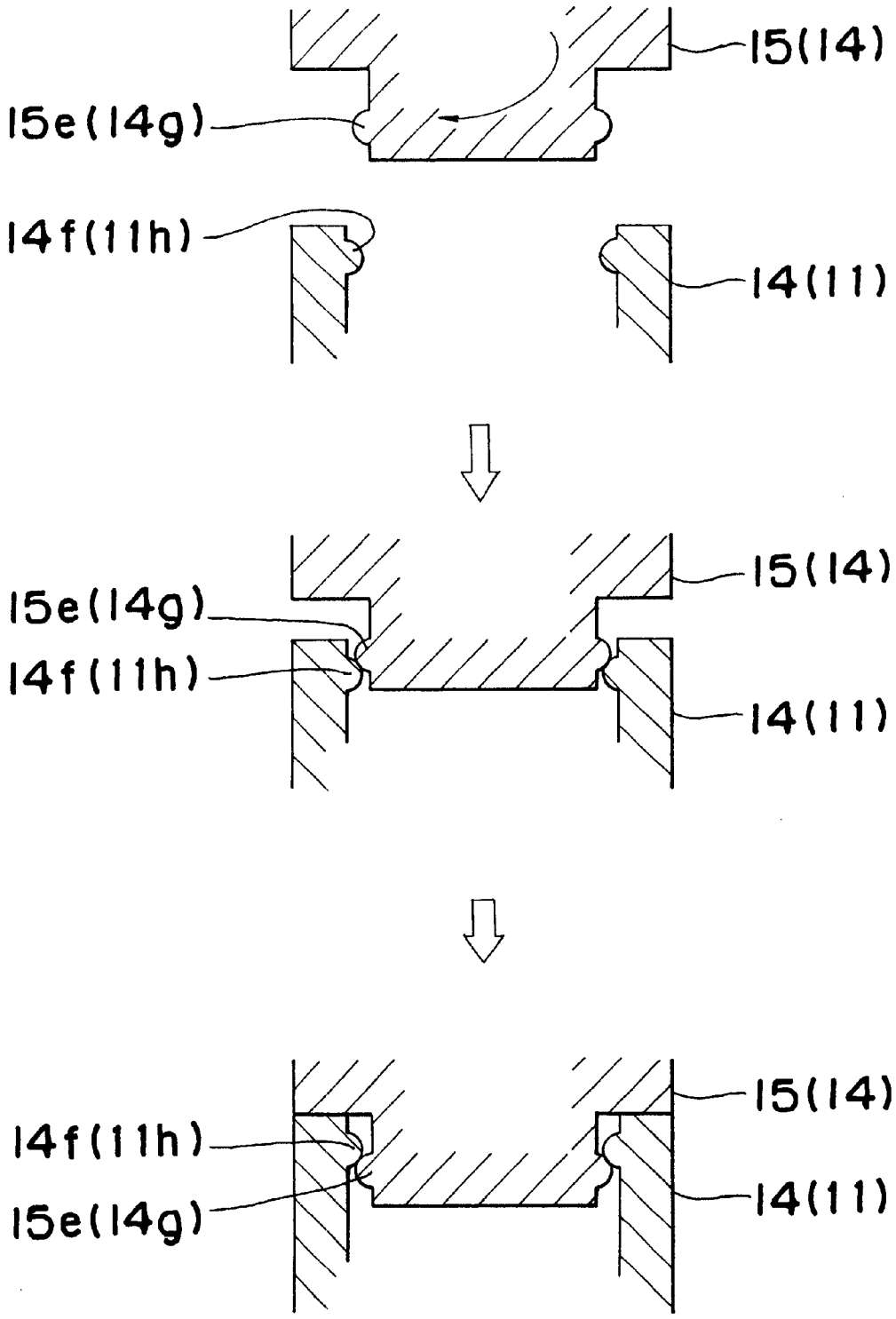
FIG. 9 showing a modified form of the container of FIG. 3.

Functions of the stoppers are shown in FIG. 9. In this FIG. 9, unparenthesized numerals correspond to functions of the first stopper means, and parenthesized numerals correspond to functions of the second stopper means. When the rotation operating cylinder 13 is rotated in one direction for the draw-in of the rod-shaped content, the push-out rod member 15 retreats while rotating relative to the relay cylinder 14, so that the two protrusions 14*f*, 15*e* formed as the first stopper means approach each other. Then, in a change from the position just before the draw-in end to the draw-in end, the two protrusions 14*f*, 15*e* contact each other and further go beyond each other so as to be engaged with each other. Also, when the rotation operating cylinder 13 is rotated reverse, the relay cylinder 14 advances while rotating relative to the shell cylinder 11, so that the protrusions 11*h*, 14*g* formed as the second stopper means approach each other. Then, in a change from the position just before the draw-out end to the draw-out end, the two protrusions 11*h*, 14*g* contact each other and further go beyond each other so as to be engaged with each other. Therefore, at the draw-in end and the draw-out end, loosening of the screws can be prevented by the first stopper 14*f*, 15*e* and the second stopper 11*h*, 14*g*, respectively, so that the content can be prevented from improvidently moving within the container 10 due to vibrations during transport or carriage. Also, in manufacturing process, whereas the relay cylinder 14 and the push-out rod member 15 need to be retained at the draw-in end position in the process of charging the content into the container 10, there are some cases, for conventional containers, where the relay cylinder 14 and the push-out rod member 15 may be shifted in position due to loosened screws, requiring readjusting their positions. However, according to this embodiment, such positional adjustment is no longer necessary.

Furthermore, in a change from the position just before the draw-in end to the draw-in end, as well as in a change from the position just before the draw-out end to the draw-out end, a clicking feeling is obtained by the protrusions formed as both stoppers 14*f*, 15*e*, 11*h*, 14*g*, thus allowing the user to easily recognize the limits of operation. Accordingly, damage of the screws due to excessive rotation of the rotation operating cylinder 13 during the operation can be prevented.

Next, a second embodiment of the rod-shaped content draw-out container according to the present invention is explained in detail with reference to FIGS. 10 through 16. In this embodiment, the first stopper means and the second stopper means are embodied unlike those of the first embodiment, while the component members other than both stopper means are the same as in the first embodiment. Therefore, the component members other than both stopper means are designated by the same reference numerals as those of the first embodiment and their detailed explanation is omitted.

The first stopper means comprises protrusions 14*f*' formed in the fore end face of the relay cylinder 14, and protrusions 15*e*' formed in the lower face of the receiver 15*b* of the push-out rod member 15, those protrusions 14*f*', 15*e*' a being provided each at four places at 90° intervals. Then, both protrusions 14*f*', 15*e*' are so formed as to go beyond each other in the rotational direction and be engaged with each other, at a positional change from the position just before the draw-in end to the draw-in end. In addition, the fore end face of the relay cylinder 14 and the lower face of the receiver 15*b* do not contact each other at the draw-in end, unlike the first embodiment, but are opposed to each other slightly away from each other.

Also, the second stopper means comprises protrusions 11*h*' formed in the lower face of the shell cylinder 11, and protrusions 14*g*' formed in the upper face of the flange 14*b* of the relay cylinder 14, those protrusions 11*h*', 14*g*' also being provided each at four places at 90° intervals and so formed as to go beyond each other in the rotational direction and be engaged with each other, at a positional change from the position just before the draw-out end to the draw-out end. In addition, the lower face of the shell cylinder 11 and the upper face of the flange 14*b* do not contact each other at the draw-out end, unlike the first embodiment, but are opposed to each other slightly away from each other.

Also with such a constitutions such occurrences that the content may be moved improvidently because of loosening of the screws at the draw-in end and the draw-out end due to vibrations during transport or carriage, or that the relay cylinder 14 and the push-out rod member 15 need to be adjusted in position in the process of charging the content can be prevented, and besides the user is allowed to easily recognize the limits of operation. Therefore, damage of the screws due. to excessive rotation of the rotation operating cylinder 13 can also be prevented.

When the protrusions 14*f*' constituting the first stopper formed in the relay cylinder 14 and the protrusions 11*h*' constituting the second stopper formed in the shell cylinder 11 are so designed as to go beyond each other in the rotational direction and be engaged with each other as in this embodiment, there can be obtained a merit that the protrusions 14*f*', 11*h*' do not make obstacles in the process of die releasing after the molding of the respective members 14, 11 in which these protrusions 14*f*', 11*h* have been formed. In the first embodiment, because the protrusions 14*f*, 11*h* are protruded radially inwardly of the respective members 14, 11, a relatively soft molding material such as polyethylene or polypropylene is used with considerations given to the die releasing of the respective members 14, 11, in which case if the content is lip cream or the like, there is a problem that perfume would adhere to the respective members 14, 11 of the container. However, in this embodiment, because the molding material can be selected optionally, polyester base hard materials to which perfume would not adhere, such as polyethylene terephthalate, are usable.

Furthermore, since the protrusions 14*f*', 11*h*' are formed in such directions as to make no obstacles in the process of die releasing of the molded products in this embodiment, the size of the protrusions 14*f*', 11*h*' can be determined optionally. Therefore, whereas the clicking feeling obtained is limited to a rather weak one because the protrusions 14*f*, 11*h* cannot be so large sized in the first embodiment, it becomes possible to obtain a stronger clicking feeling by enlarging the protrusions 14*f*', 11*h*' in this embodiment.

Figure 17:
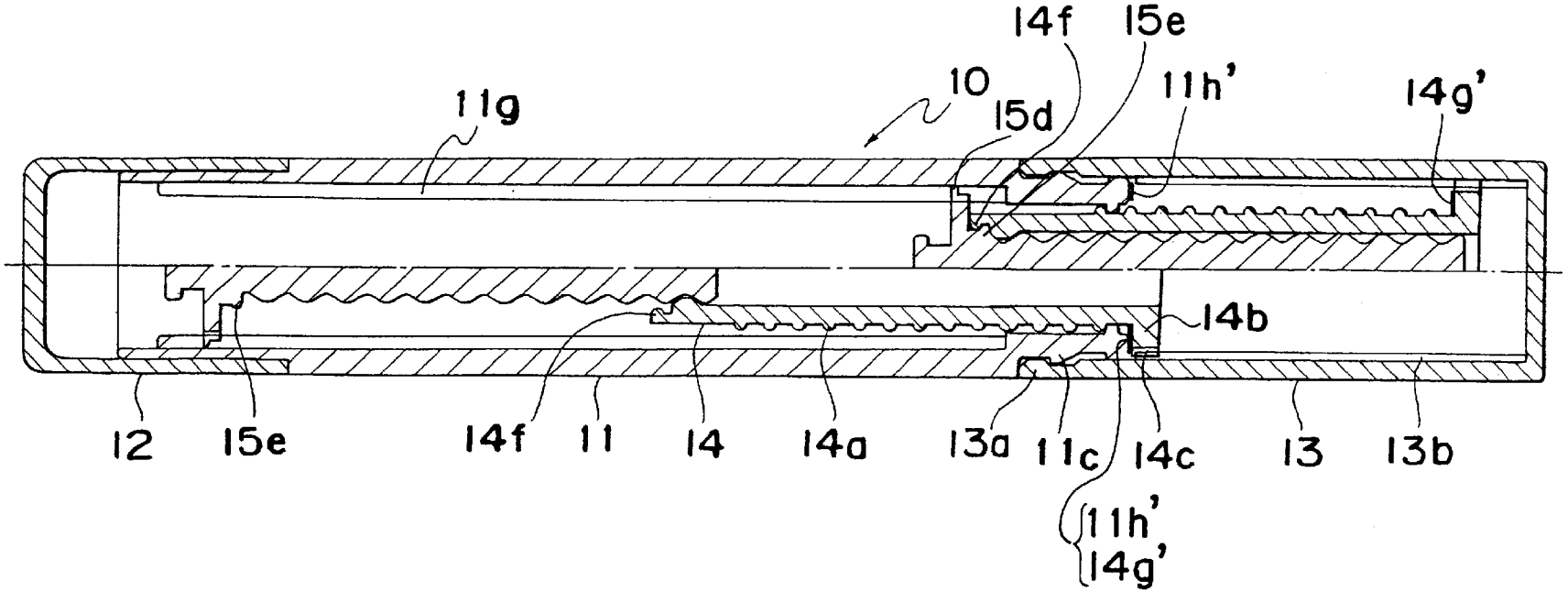
FIG. 17 is a sectional view showing a third embodiment of the rod-shaped content draw-out container according to the present invention, the upper half showing a drawn-in state and the lower half showing a drawn-out state.
Figure 18:
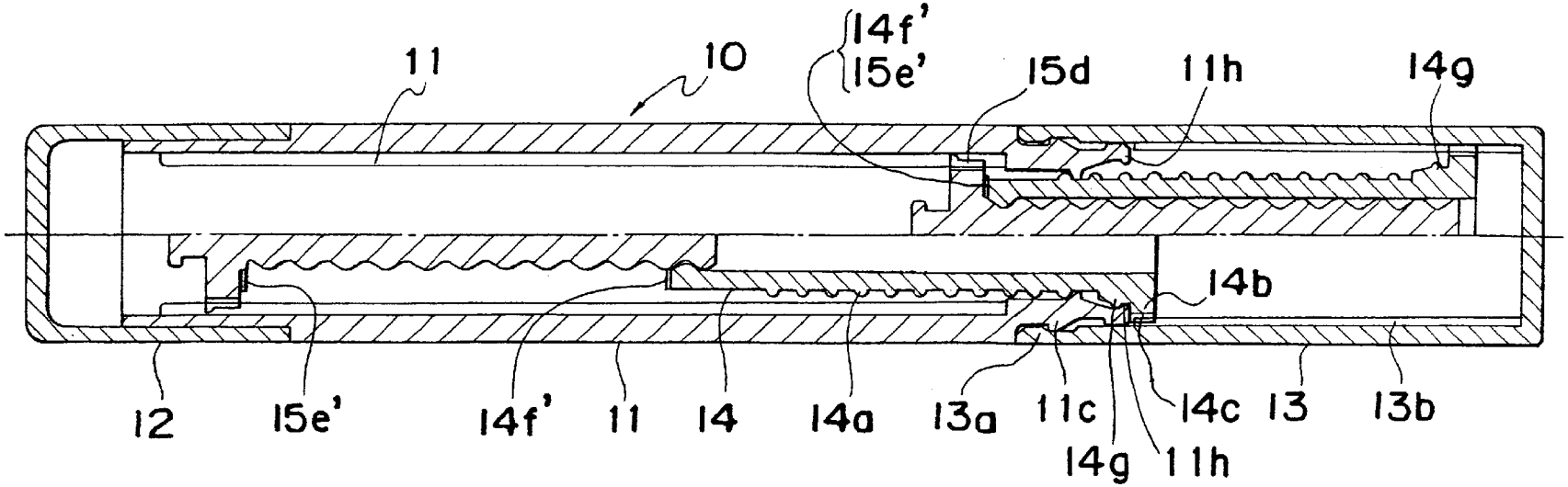
FIG. 18 is a sectional view showing a fourth embodiment of the rod-shaped content draw-out container according to the present invention, the upper half showing a drawn-in state and the lower half showing a drawn-out state.

In addition, the present invention is not limited to the above-described embodiments, and may be embodied in other various ways. For example, the first stopper means and the second stopper means may be a combination of a protrusion that goes beyond in the axial direction and a protrusion that goes beyond in the rotational direction. More specifically, as shown in FIG. 17, it is possible to combine first stopper means comprising protrusions that go beyond each other axially so as to be engaged with each other as shown by numerals 14*f*, 15*e*, (see also FIG. 3) and the second stopper means comprising protrusions that go beyond each other in the rotational direction so as to be engaged with each other as shown by numerals 11*h*', 14*g*', (see also FIG. 10) and conversely, as shown in FIG. 18, to combine first stopper means comprising protrusions that go beyond each other in the rotational direction so as to be engaged with each other as shown by numerals 14*f*', 15*e*', (see also FIG. 10) and second stopper means comprising protrusions that go beyond each other axially so as to be engaged with each other as shown by numerals 11*h*, 14*g* (see also FIG. 3).

Furthermore, in the above embodiments, the first stopper means comprises one protrusion and another protrusion which go beyond each other so as to be engaged with each other at a positional change from the position just before the draw-in end to the draw-in end, while the second stopper means comprises one protrusion and another protrusion which go beyond each other so as to be engaged with each other at a positional change from the position just before the draw-out end to the draw-out end. However, the first stopper means may comprise a protrusion and a recessed portion which are fitted to each other at a positional change from the position just before the draw-in end to the draw-in end, while the second stopper means may comprise a protrusion and a recessed portion which go beyond each other so as to be engaged with each other at a positional change from the position just before the draw-out end to the draw-out end.

Figure 9A:
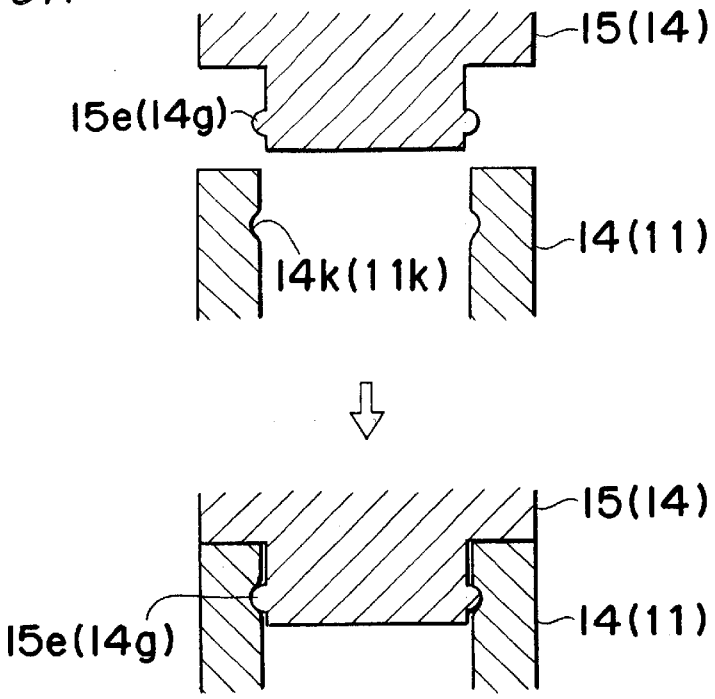
FIG. 9A is a function explanatory view similar to FIG. 9 showing a modified form of the container of FIG. 3.
Figure 16A:
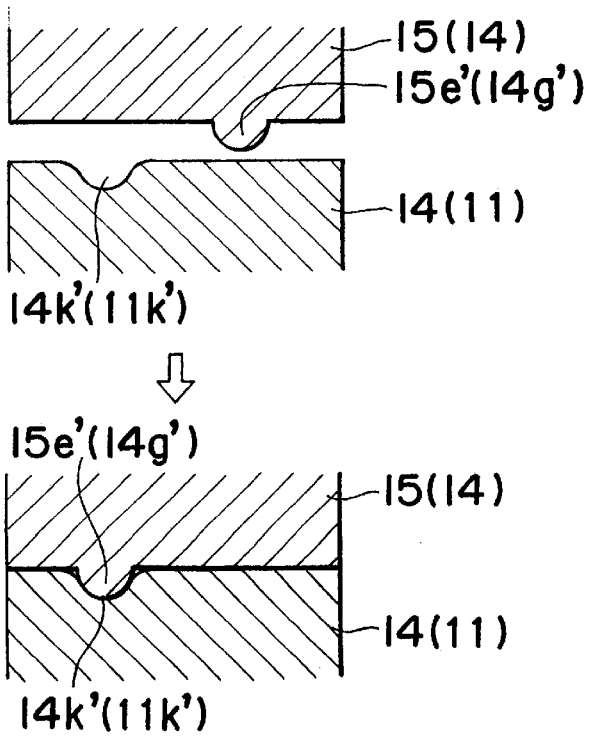
FIG. 16A is a function explanatory view similar to FIG. 16 showing a modified form of the container of FIG. 10.
Figure 10:
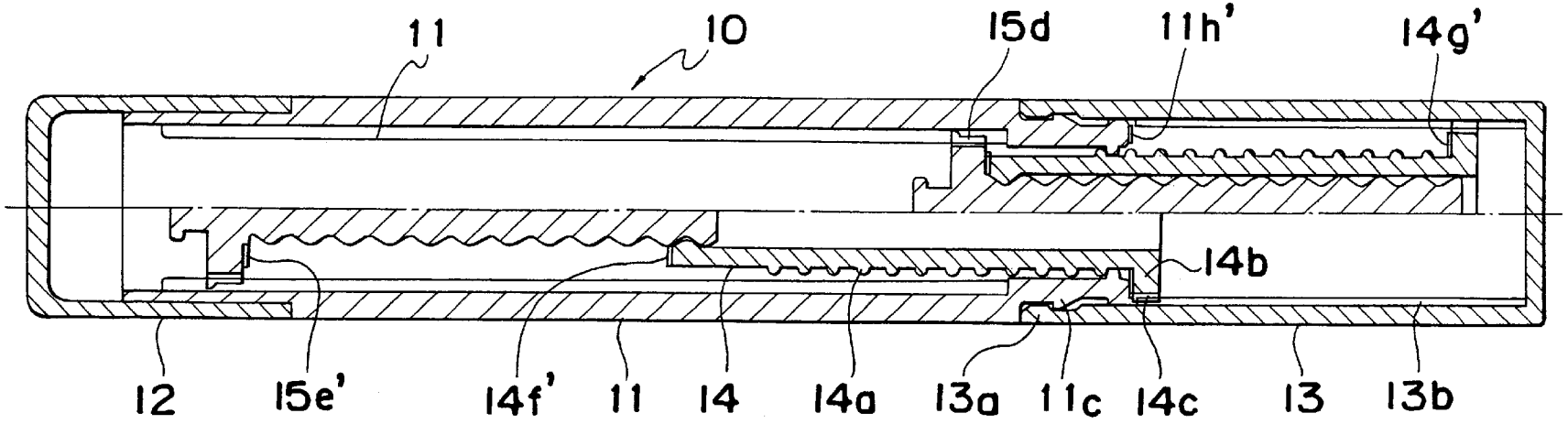
FIG. 10 is a sectional view showing a second embodiment of the rod-shaped content draw-out container according to the present invention, the upper half showing a drawn-in state and the lower half showing a drawn-out state.
Figure 11:
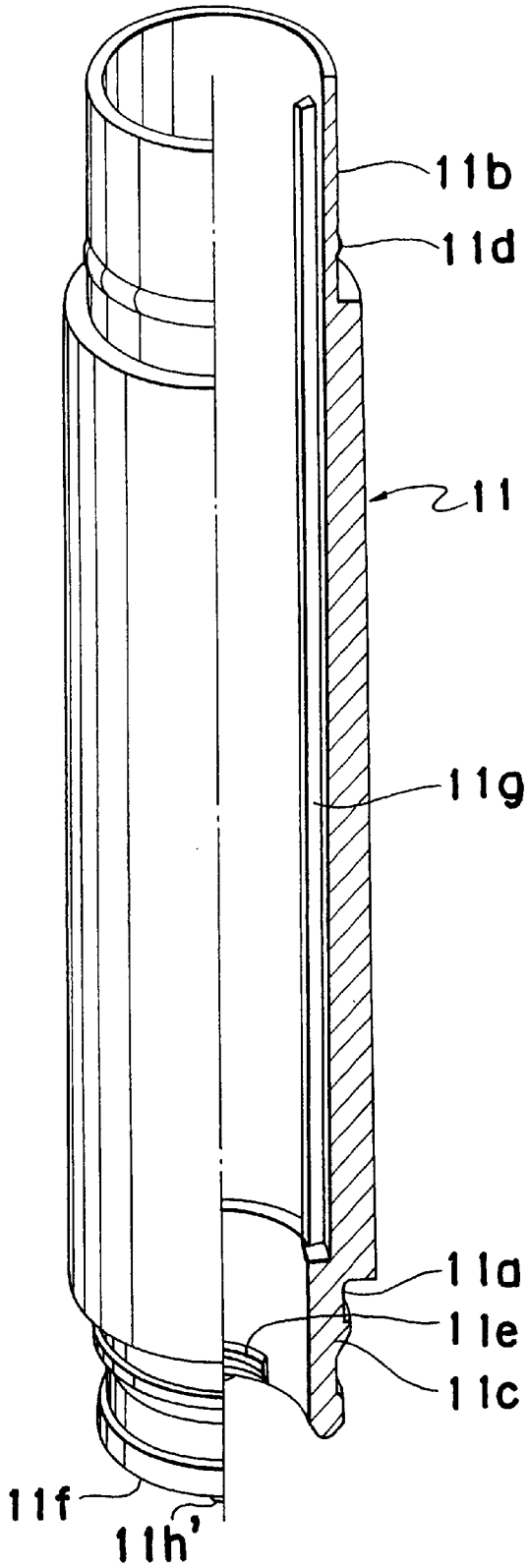
FIG. 11 is a partial sectional perspective view showing the shell cylinder of the container of FIG. 10.
Figure 12:
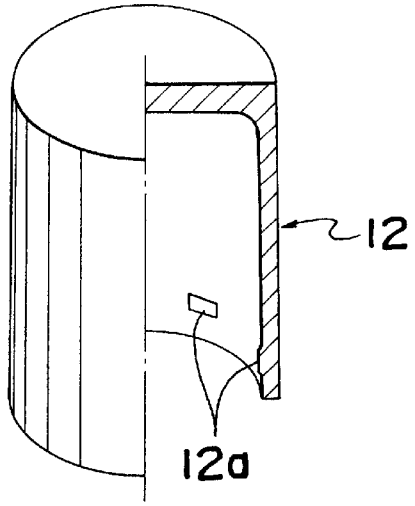
FIG. 12 is a partial sectional perspective view showing the cap of the container of FIG. 10.
Figure 13:
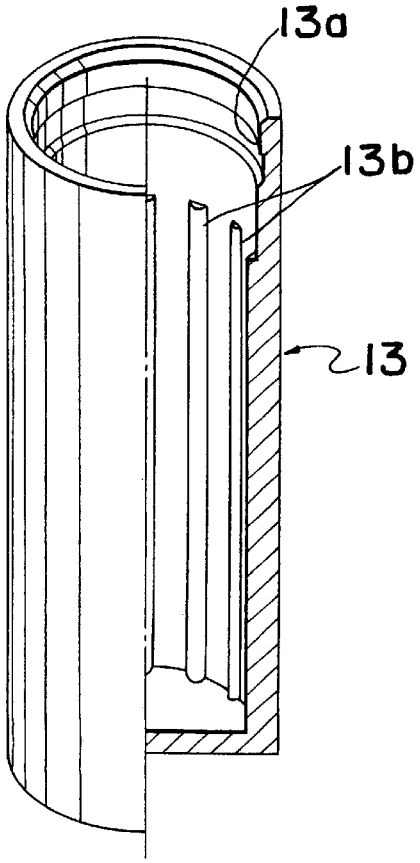
FIG. 13 is a partial sectional perspective view showing the rotation operating cylinder of the container of FIG. 10.
Figure 14:
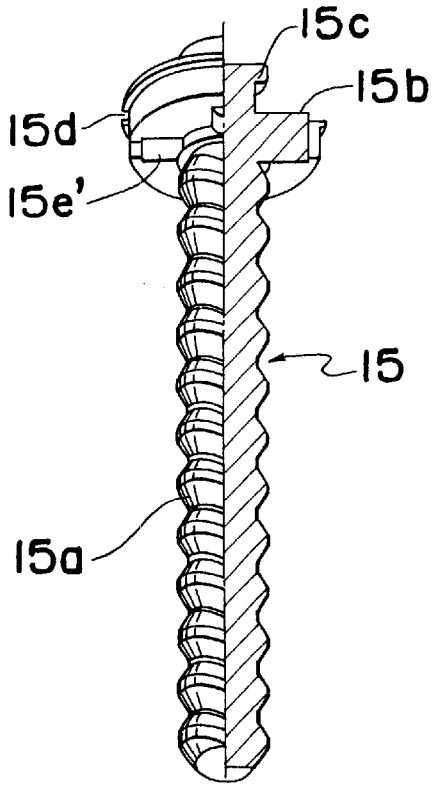
FIG. 14 is a partial sectional perspective view showing the push-out rod member of the container of FIG. 10.
Figure 15:
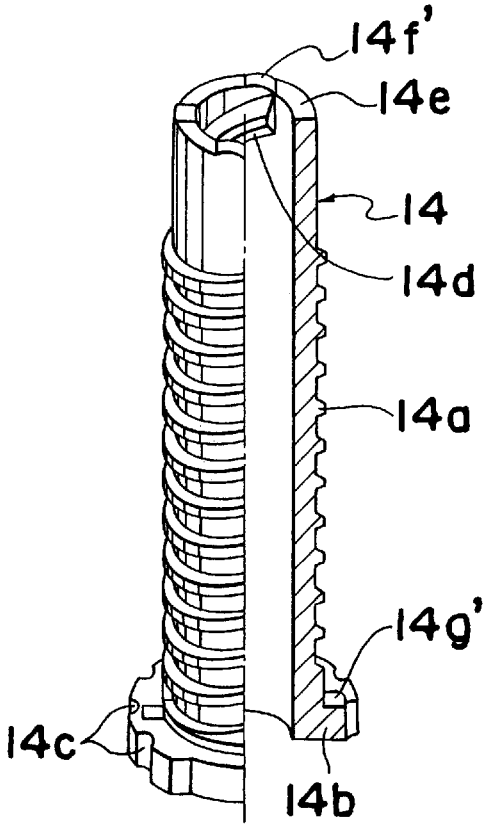
FIG. 15 is a partial sectional perspective view showing the relay cylinder of the container of FIG. 10.
Figure 16:
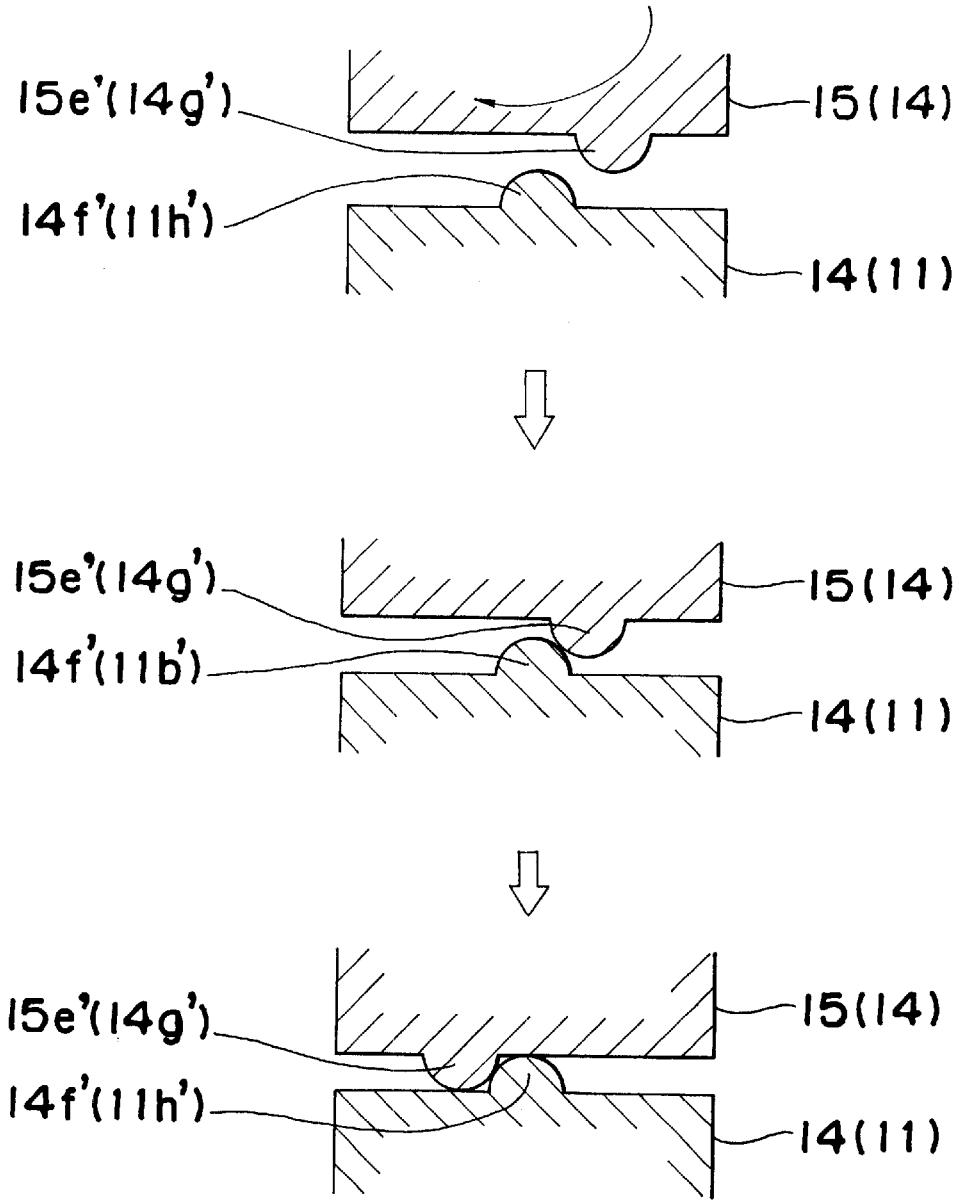
FIG. 16 is a function explanatory view of a first stopper and a second stopper provided for holding the draw-in end and the draw-out end in the container of FIG. 10.

Referring to FIG. 9A, which shows stopper members that engage each other in an axial direction, the first stopper members comprising a protrusion 15*e* formed in the outer circumference of the push out rod member 15 and a recess 14*k* formed in the inner circumference of the relay cylinder 14 engage each other as the assembly is manipulated from just before the drawn-in end to the drawn-in end. Similarly, the second stopper members comprising a protrusion 14*g* formed on the outer circumference of the relay cylinder 14 and a recess 11*k* formed on the inner circumference of the shell cylinder 11 engage each other as the assembly is manipulated from just before the draw-out end to the draw-out end. Referring to FIG. 16A, which shows stopper members that engage each other in a rotational direction, the first stopper members comprising a protrusion 15*e*' formed on the lower face of the receiver 15*b* of the push-out rod member 15 and a recess 14*k*' formed on the upper axial end face of the relay cylinder 11 engage each other as the assembly is manipulated from just before the draw-in end to the draw-in end. Similarly, the second stopper members comprising a protrusion 14*g*' formed on the upper face of the flange 14*b* of the relay cylinder 14*g* and a recess 11*k*' formed in the lower axial end face of the shell cylinder 11 engage each other as the assembly is manipulated from just before the draw-out end to the draw-out end.

What is claimed is:

1. A rod-shpaed content draw-out container comprising: a shell cylinder having a screwer in an inner circumferential surface of a rear end; a rotation operating cylinder rotatably coupled to the rear end of the shell cylinder; a relay cylinder which has an outside screw to be screwed to the screwer of the shell cylinder and which is inhibited from rotating relative to the rotation operating cylinder but allowed to advance and retreat axially, and further which has a screwer formed in an inner circumferential surface; a push-out rod member which has an outside screw to be screwed to the screwer of the relay cylinder and which is inhibited from rotating relative to the shell cylinder but allowed to advance and retreat axially, and further which has, at its fore end portion, a receiver for holding a rear end of a rod-shaped content, wherein the outside screw of the relay cylinder and the outside screw of the push-out rod member and threaded reverse to each other, the rod-shaped content draw-out container being characterized in that:

a pair of first stoppers to be engaged at a draw-in end are formed in the inner circumferential surface of the relay cylinder and an outer circumferential surface of the push-out rod member, the pair of first stoppers comprising one protrusion and another protrusion which go axially beyond each other at a positional change from a position just before the draw-in end to the draw-in end, or a protrusion and a recessed portion which are fitted to each other at the positional change from the position just before the draw-in end to the draw-in end, and that a pair of second stoppers to be engaged at a draw-out end are formed in the inner circumferential surface of the shell cylinder and an outer circumferential surface of the relay cylinder, the pair of second stoppers comprising one protrusion and another protrusion which go axially beyond each other at a positional change from a position just before the draw-out end to the draw-out end, or a protrusion and a recessed portion which are fitted to each other at the positional change from the position just before the draw-out end to the draw-out end.

2. A rod-shaped content draw-out container comprising: a shell cylinder having a screwer in an inner circumferential surface of a rear end; a rotation operating cylinder rotatably coupled to the rear end of the shell cylinder; a relay cylinder which has an outside screw to be screwed to the screwer of the shell cylinder and which is inhibited from rotating relative to the rotation operating cylinder but allowed to advance and retreat axially, and further which has a screwer formed in an inner circumferential surface; a push-out rod member which has an outside screw to be screwed to the screwer of the relay cylinder and which is inhibited from rotating relative to the shell cylinder but allowed to advance and retreat axially, and further which has, at its fore end portion, a receiver for holding a rear end of a rod-shaped content, wherein the outside screw of the relay cylinder and the outside screw of the push-out rod member are threaded reverse to each other, and the relay cylinder has a fore end face to be opposed to a lower face of the receiver at a draw-in position, and a flange to be opposed to a lower face of the shell cylinder at a draw-out position, the rod-shaped content draw-out container being characterized in that:

a pair of first stoppers to be engaged at the draw-in end are formed in the fore end face of the relay cylinder and the lower face of the receiver of the push-out rod member, the pair of first stoppers comprising one protrusion and another protrusion which go beyond each other in a rotational direction at a positional change from a position just before the draw-in end to the draw-in end, or a protrusion and a recessed portion which are fitted to each other at the positional change from the position just before the draw-in end to the draw-in end, and that a pair of second stoppers to be engaged at a draw-out end are formed in the lower face of the shel cylinder and an upper face of the flange of the relay cylinder, the pair of second stoppers comprising one protrusion and another protrusion which go beyond each other in the rotational direction at a positional change from a position just before the draw-out end to the draw-out end, or a protrusion and a recessed portion which are fitted to each other at the positional change from the position just before the draw-out end to the draw-out end.

3. A rod-shaped content draw-out container comprising: a shell cylinder having a screwer in an inner circumferential surface of a rear end; a rotation operating cylinder rotatably coupled to the rear end of the shell cylinder; a relay cylinder which has an outside screw to be screwed to the screwer of the shell cylinder and which is inhibited from rotating relative to the rotation operating cylinder but allowed to advance and retreat axially, and further which has an outside screw to be screwed to the screwer of the relay cylinder and which is inhibited from rotating relative to the shell cylinder but allowed to advance and retreat axially, and further which has, at its fore end portion, a receiver for holding a rear end of a rod-shaped content, wherein the outside screw of the relay cylinder and the outside screw of the push-out rod member are threaded reverse to each other, and the relay cylinder has a flange to be opposed to a lower face of the shell cylinder at a draw-out position, the rod-shaped content draw-out container being characterized in that:

a pair of first stoppers to be engaged at a draw-in end are formed in the inner circumferential surface of the relay cylinder and an outer circumferential surface of the push-out rod member, the pair of first stoppers comprising one protrusion and another protrusion which go axially beyond each other at a positional change from a position just before the draw-in end to the draw-in end, or a protrusion and a recessed portion which are fitted to each other at the positional change from the position just before the draw-in end to the draw-in end, and that a pair of second stoppers to be engaged at a draw-out end are formed in the lower face of the shell cylinder and an upper face of the flange of the relay cylinder, the pair of second stoppers comprising one protrusion and another protrusion which go beyond each other in the rotational direction at a positional change from a position just before the draw-out end to the draw-out end, or a protrusion and a recessed portion which are fitted to each other at the positional change from the position just before the draw-out end to the draw-out end.

4. A rod-shaped content draw-out container comprising: a shell cylinder having a screwer in an inner circumferential surface of a rear end; a rotation operating cylinder rotatably coupled to the rear end of the shell cylinder; a relay cylinder which has an outside screw to be screwed to the screwer of the shell cylinder and which is inhibited from rotating relative to the rotation operating cylinder but allowed to advance and retreat axially, and further which has a screwer formed in an inner circumferential surface; a push-out rod member which has an outside screw to be screwed to the screwer of the relay cylinder and which is inhibited from rotating relative to the shell cylinder but allowed to advance and retreat axially, and further which has, at its fore end portion, a receiver for holding a rear end of a rod-shaped content, wherein the outside screw of the relay cylinder and the outside screw of the push-out rod member are threaded reverse-to each other, and the relay cylinder has a fore end face to be opposed to a lower face of the receiver at a draw-in end position, the rod-shaped content draw-out container being characterized in that:

a pair of first stoppers to be engaged at the draw-in end are formed in the fore end face of the relay cylinder and the lower face of the receiver of the push-out rod member, the pair of first stoppers comprising one protrusion and another protrusion which go beyond each other in a rotational direction at a positional change from a position just before the draw-in end to the draw-in end, or a protrusion and a recessed portion which are fitted to each other at the positional change from the position just before the draw-in end, and that a pair of second stoppers to be engaged at a draw-out end are formed in the inner circumferential surface of the shell cylinder and an outer circumferential surface of the relay cylinder, the pair of second stoppers comprising one protrusion and another protrusion which go axially beyond each other at a positional change from a position just before the draw-out end to the draw-out end, or a protrusion and a recessed portion which are fitted to each other at the positional change positional change from the position just before the draw-out end to the draw-out end.

* * * * *

UNITED STATES PATENT AND TRADEMARK OFFICE

CERTIFICATE OF CORRECTION

PATENT NO. : 6,361,233 B1 
DATED : March 26, 2002
INVENTOR(S) : Yasuhiro Yamanaka et al.

It is certified that error appears in the above-identified patent and that said Letters Patent is hereby corrected as shown below:

Title page,
Item [73], please add the Assignee -- Rohto Pharmaceutical Co., Ltd., Osaka, Japan. --

Signed and Sealed this

Twenty-sixth Day of August, 2003

JAMES E. ROGAN
*Director of the United States Patent and Trademark Office*